US010246957B2

(12) United States Patent
Marr

(10) Patent No.: US 10,246,957 B2
(45) Date of Patent: Apr. 2, 2019

(54) DOWNHOLE TOOL AND METHOD TO BOOST FLUID PRESSURE AND ANNULAR VELOCITY

(71) Applicant: Halliburton Energy Services, Inc., Houston, TX (US)

(72) Inventor: Alan William Marr, Angus (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 570 days.

(21) Appl. No.: 14/890,625

(22) PCT Filed: Jul. 16, 2013

(86) PCT No.: PCT/US2013/050731

§ 371 (c)(1),
(2) Date: Nov. 12, 2015

(87) PCT Pub. No.: WO2015/009289

PCT Pub. Date: Jan. 22, 2015

(65) Prior Publication Data

US 2016/0123098 A1 May 5, 2016

(51) Int. Cl.

| | |
|---|---|
| ***E21B 21/08*** | (2006.01) |
| ***E21B 21/00*** | (2006.01) |
| ***E21B 4/00*** | (2006.01) |
| ***F04D 13/14*** | (2006.01) |

(52) U.S. Cl.
CPC ..... *E21B 21/08* (2013.01); *E21B 4/006* (2013.01); *E21B 21/00* (2013.01); *F04D 13/14* (2013.01)

(58) Field of Classification Search
CPC ..... E21B 21/08; E21B 21/00; E21B 4/06
See application file for complete search history.

(56) References Cited

U.S. PATENT DOCUMENTS

| | | | | |
|---|---|---|---|---|
| 2,833,517 | A | 5/1958 | Bobo | |
| 3,981,626 | A | 9/1976 | Onal | |
| 4,049,066 | A * | 9/1977 | Richey | E21B 4/02 175/107 |
| 4,580,632 | A | 4/1986 | Reardon | |
| 4,669,555 | A * | 6/1987 | Petree | E21B 4/02 175/107 |
| 6,719,071 | B1 | 4/2004 | Moyes | |
| 6,997,272 | B2 | 2/2006 | Eppink | |
| 7,055,627 | B2 | 6/2006 | Fontana et al. | |
| 7,434,634 | B1 | 10/2008 | Hall et al. | |
| 7,455,113 | B2 | 11/2008 | Booth | |
| 8,132,630 | B2 | 3/2012 | Krueger et al. | |
| 2010/0155067 | A1 | 6/2010 | Tunget | |
| 2010/0316504 | A1 * | 12/2010 | Lack | E21B 43/126 417/53 |

(Continued)

OTHER PUBLICATIONS

Bern, et al., "*A New Downhole Tool for ECD Reduction*," Society of Petroleum Engineers, IAD/SPE Underbalanced Technology Conference and Exhibition, Mar. 25-26, 2003.

(Continued)

*Primary Examiner* — D. Andrews
*Assistant Examiner* — Yanick A Akaragwe

(57) ABSTRACT

A disclosed embodiment of a downhole tool includes a pump that is powered by rotation of the drill string to increase fluid pressure during downhole circulation.

17 Claims, 5 Drawing Sheets

(56) References Cited

U.S. PATENT DOCUMENTS

| | | | | |
|---|---|---|---|---|
| 2011/0120775 | A1* | 5/2011 | Krueger | E21B 7/067 175/73 |
| 2011/0150687 | A1 | 6/2011 | Ree | |

OTHER PUBLICATIONS

International Preliminary Report on Patentability, dated Apr. 8, 2015, PCT/US2013/050731, 8 pages, IPEA/US.
International Search Report and the Written Opinion of the International Searching Authority, or the Declaration, dated Apr. 9, 2014, PCT/US2013/050731, 9 pages, ISA/US.

* cited by examiner

DOWNHOLE TOOL AND METHOD TO BOOST FLUID PRESSURE AND ANNULAR VELOCITY

The present application is a U.S. National Stage patent application of International Patent Application No. PCT/US2013/050731, filed on Jul. 16, 2013, the benefit of which is claimed and the disclosure of which is incorporated herein by reference in its entirety.

FIELD OF THE DISCLOSURE

The present disclosure relates generally to the circulation of drilling and completion fluids and, more specifically, to a downhole tool which imparts additional energy to such fluids during circulation.

BACKGROUND

A hydrocarbon recovery well may be drilled by rotating a drill string, which is an assembly that generally includes a plurality of interconnected drill pipe segments having a drill bit and bottom hole assembly ("BHA") at a lower end. As the well is drilled, the drill bit generates cuttings and other debris. In downhole drilling operations, fluid circulation is commonly used for wellbore cleaning and solids transport, such as to remove the cuttings and other debris. In general, circulation involves pumping fluid down the drill string (using a mud pump at the surface) and back up the annulus between the drill string and a wellbore wall. The speed at which the fluid moves along the annulus is referred to as the annular velocity. Thus, it is important to monitor the annular velocity to ensure proper wellbore cleaning, solid transport, as well as to avoid erosion of the wellbore wall.

The fluid annular velocity is adversely affected in a number of ways. For example, during circulation, pressure drops occur in the circulating system due to frictional losses inside the tubing and the annulus, as well as the differential hydrostatic pressure between the tubing and annulus. The maximum pressure is generated at the mud pump manifold (the standpipe pressure ("SPP")) and the lowest pressure is generated at the fluid returns (atmospheric pressure for open returns or applied choke pressure for managed pressure operations). Thus, the fluid velocity is limited by the maximum SPP. As a result, in some instances, the annular velocity may not be high enough to sufficiently clean the wellbore. However, if the fluid pressure is somehow increased during circulation, the SPP can be reduced. In turn, this would permit an increase in the maximum pump rate which produces higher annular velocities.

Accordingly, in view of the foregoing, there is a need in the art for a method to increase the fluid annular velocity.

DESCRIPTION OF ILLUSTRATIVE EMBODIMENTS

Figure 1:
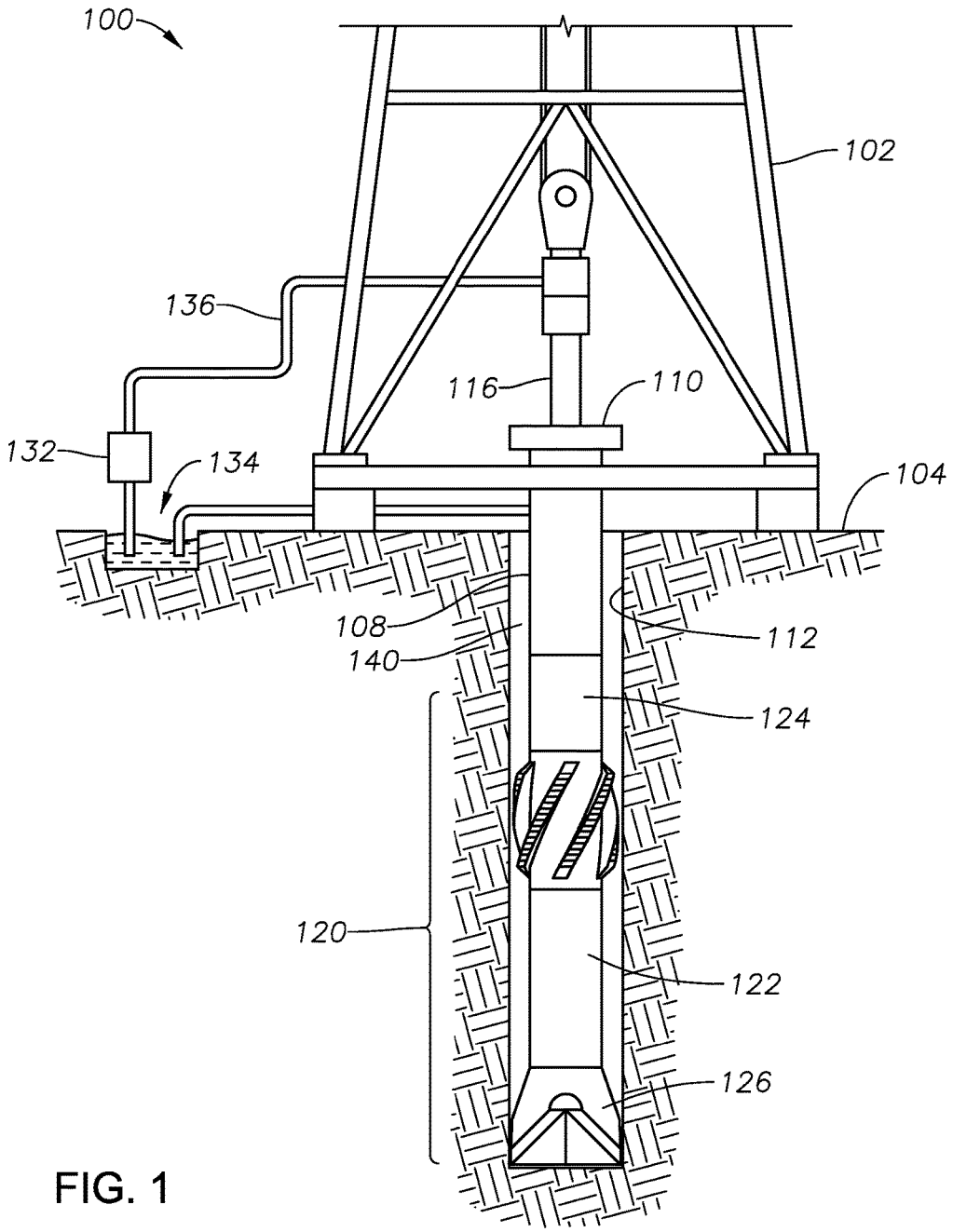
FIG. 1 illustrates a circulation system for drilling operations, according to certain exemplary embodiments of the present disclosure.

Illustrative embodiments and related methodologies of the present disclosure are described below as they might be employed in a downhole tool which boosts fluid annular pressure during circulation, thus permitting higher fluid annular velocities. In the interest of clarity, not all features of an actual implementation or methodology are described in this specification. Also, the "exemplary" embodiments described herein refer to examples of the present disclosure. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, exemplary embodiments of the present disclosure are directed to an in-line downhole tool driven by the drill string rotation in order to drive a pump mechanism that boosts fluid pressure during circulating, thus permitting an increase in annular velocity. One disclosed embodiment of a downhole tool comprises a drive mechanism that includes a drive gear and drive shaft in order to harness a torque (i.e. a rotational force) created by rotating the drill string. As used herein, the term "gear" broadly refers to any rotational member having a surface along a periphery configured to engage with a surface along the periphery of another rotational member. In the example embodiments discussed below, the gears described may be conventional gears having a plurality of teeth configured to mesh with a corresponding plurality of teeth on the other rotational member (e.g. another gear or a gear ring). However, such a gear may alternatively comprise, for example, a surface on the periphery of the gear that, without the use of conventional gear teeth, frictionally meshes with a corresponding surface on the other rotational member, such that rotation of one causes rotation of the other without the use of teeth. The surfaces for frictionally engaging one another may be imparted with a high coefficient of friction, such as by roughening the surfaces or applying a frictional material such as a rubber compound. In response to rotation of the drill string, the drive gear rotates to transfer power (via application of a torque) to a drive shaft coupled to the pump mechanism. The drive shaft rotates in response to the applied torque, to then transmit power from the drive shaft to the pump assembly a to drive the pump assembly, to boost the pressure of fluid traveling through the downhole tool. These and other features of the present disclosure will be described in further detail below.

FIG. 1 illustrates a circulation system for drilling operations, according to certain exemplary embodiments of the present disclosure. Drilling system 100 (rotary-type, for example) includes a drilling rig 102 located at a surface 104 of a wellbore. Drilling rig 102 provides support for a drill string 108. Drill string 108 penetrates a rotary table 110 for drilling a wellbore 112 through subsurface formations. In this exemplary embodiment, drill string 108 includes a Kelly 116 (in the upper portion) and a bottom hole assembly 120 located at the lower portion of drill string 108. Bottom hole assembly 120 includes a drill collar 122, a downhole tool 124 to boost fluid pressure, and a drill bit 126. Additionally, although not shown, bottom hole assembly 120 may comprise any number of other downhole tools such as, for example, Measurement While Drilling (MWD) tools, Logging While Drilling (LWD) tools, etc.

During drilling operations, the drill string 108 and the bottom hole assembly 120 are rotated by the rotary table 110 or a top drive, as generally understood in the art apart from the specific teachings of this disclosure. In other embodiments, such as in directional drilling applications, a drill bit may alternatively be rotated by a motor (not shown) that is positioned downhole. Drill collar 122 may be used to add weight to the drill bit 126 and to stiffen bottom hole assembly 120, thus allowing bottom hole assembly 120 to transfer the weight to drill bit 126. Accordingly, this weight provided by the drill collar 122 also assists drill bit 126 in the penetration of the surface 104 and the subsurface formations.

During drilling operations, a mud pump 132 may pump drilling fluid (known as "drilling mud") from a mud pit 134 through a hose 136, into the drill pipe (located along drill string 108), through downhole tool 124, and down to drill bit 126. As described herein, exemplary embodiments of downhole tool 124 are used to harness the rotation of the drill string in order to power a pump mechanism that increases the pressure of the fluid as it travels through downhole tool 124. The drilling fluid can then flow out from drill bit 126 and return back to the surface through an annular area 140 between drill string 108 and the sides of the wellbore 112 (i.e., circulation). The drilling fluid may then be returned to mud pit 134, where such fluid is filtered. Accordingly, the drilling fluid can cool drill bit 126 as well as provide for lubrication of drill bit 126 during the drilling operation. Additionally, the drilling fluid removes the cuttings of the subsurface formations created by drill bit 126.

Figure 2A:
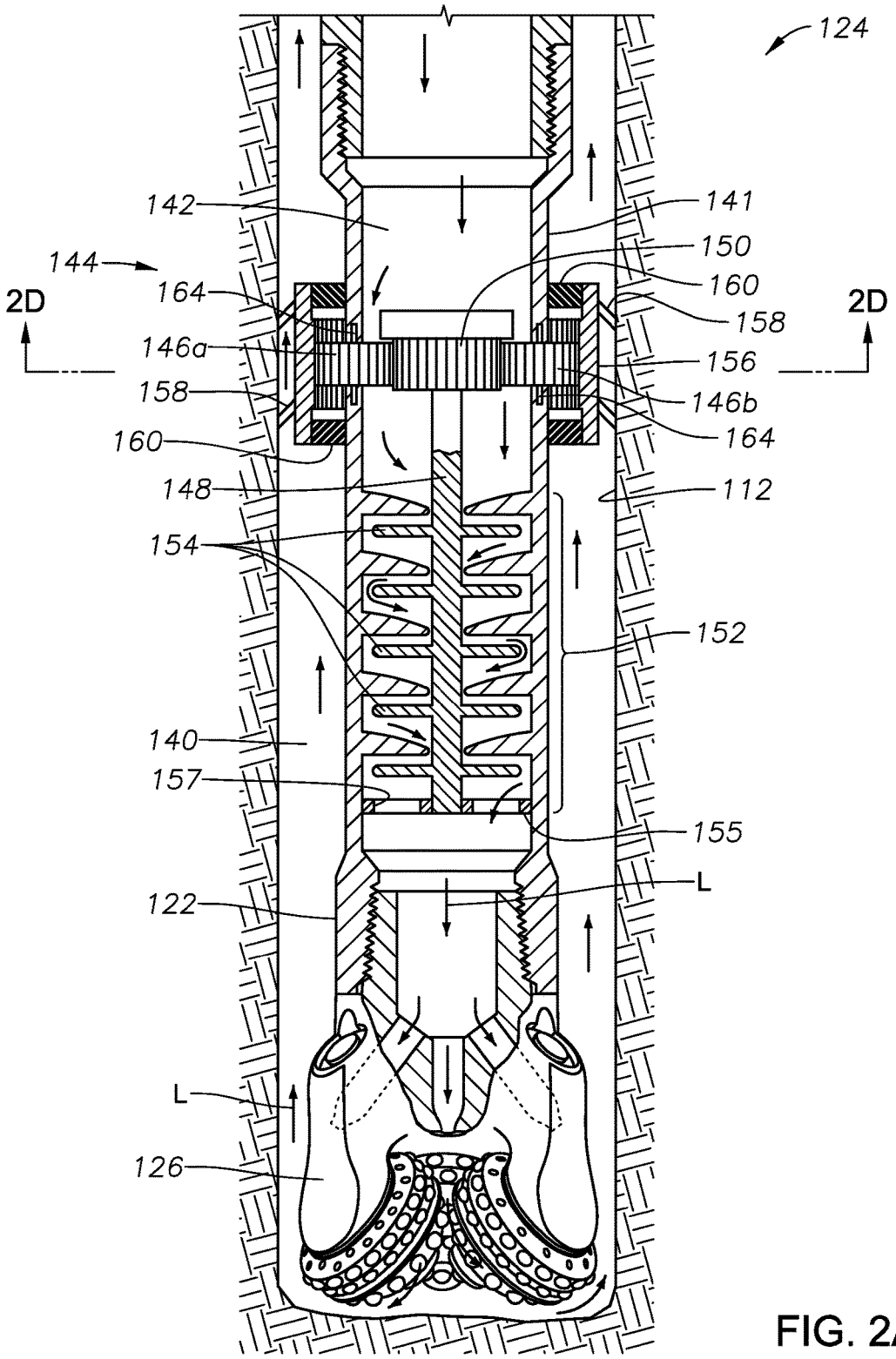
FIG. 2A is a sectional view of a downhole tool, according to certain exemplary embodiments of the present disclosure.

With reference to FIG. 2A, certain exemplary embodiments of downhole tool 124 will now be described in detail. FIG. 2A is a sectional view of downhole tool 124 positioned along a drill string. Alternatively, however, downhole tool 124 may also be used in other bottom hole assemblies in which fluid circulation in conducted, such as, for example, a completion assembly. Downhole tool 124 includes a tool housing 141 defining a fluid flow passage (referred to herein as a "bore") 142 extending through, in which fluids (drilling or completion fluid, for example) may flow. A drive mechanism 144 is positioned along bore 142. The drive mechanism 144 includes, by way of example, two drive gears 146*a* and 146*b* positioned along tool housing 141 and opposite one another with respect to a drive shaft 148. Drive shaft 148 is operationally coupled to drive gears 146*a,b* via a central gear 150 located at its upper end. In this exemplary embodiment, drive gears 146*a,b* mesh with another gear, referred to herein as a "central gear" 150 in order to transfer rotational force to drive shaft 148.

A pump mechanism 152 is operationally coupled to drive shaft 148 in order to receive power via an applied torque imparted by drive shaft 148. In turn, pump mechanism 152 uses the rotation of the drive shaft 148 to drive the pump 152 to thereby increase the pressure of fluid traveling through downhole tool 124, with a corresponding increase in the fluid annular velocity. In certain embodiments, drive shaft 148 forms a part of pump mechanism 152, while in other embodiments the drive shaft 148 may be a separate component not included with the pump mechanism 152, but operationally coupled to another rotating member of the pump mechanism 152, to power the pump 150. In this exemplary embodiment, pump mechanism 152 is a multi-stage impeller assembly comprising a plurality of impeller plates 154 arranged in series to one another. Alternatively, other pumping mechanisms may be used, such as, for example, a turbine, jet pump, or another centrifugal-type pump. Centrifugal-type pumps are especially beneficial because it will produce additional hydraulic pressure, relieve some of the standpipe pressure, and may still be used if the in-line pump drive failed.

Still referring to the exemplary embodiment of FIG. 2A, drive mechanism 144 also includes a sleeve 156 positioned around tool housing 141. The outer surface of sleeve 156 includes one or more gripping members 158 to engage the wall of wellbore 112 such that sleeve 156 remains stationary during rotation of tool housing 141 during circulation operations. In certain exemplary embodiments, the diameter of sleeve 156 is selected such that it vertically slides up/down along the wall of wellbore 112 during deployment and retrieval of bottom hole assembly 120, while also preventing the rotation of sleeve 156 when drill string 108 is rotated. The proper diameter can be determined, for example, using the internal diameter of the casing or wellbore.

Figure 2C:
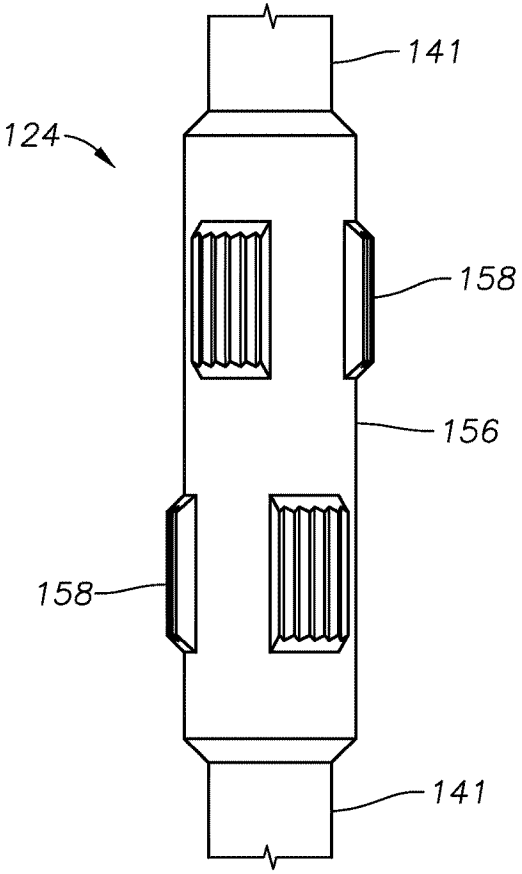
FIG. 2C is a three-dimensional view of a downhole tool which includes a plurality of offset gripping members, in accordance to certain exemplary embodiments of the present disclosure.
Figure 2B:
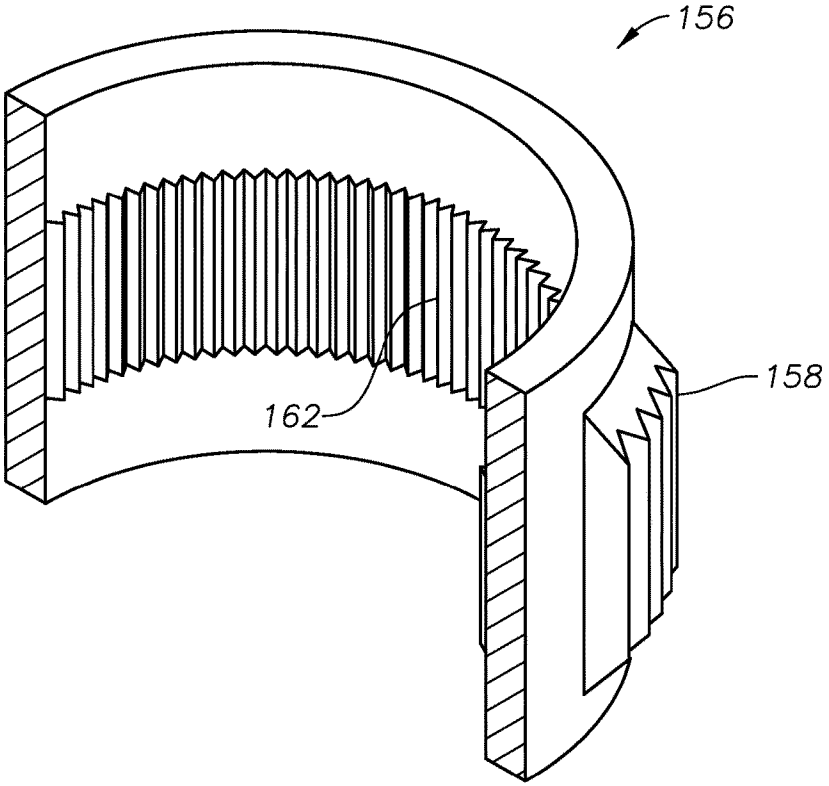
FIG. 2B illustrates a cut-away view of a gear ring located along the inner surface of the rotating sleeve of a downhole tool, in accordance to certain exemplary embodiments of the present disclosure.

A mechanical seal 160 is positioned around tool housing 141 at the upper and lower ends of sleeve 156 to provide protection against leakage of fluids from annulus 140 into the area surrounding drive gears 146*a,b*. The seals may be made of, for example, metal, plastic or ceramic materials. A gear ring 162 is located along the inner surface of sleeve 156, as shown in FIG. 2B. Gear ring 162 comprises a series of teeth secured to or integrally formed with the sleeve 152, which mesh with teeth positioned along the periphery of each of the drive gears 146*a,b*. Drive gears 146*a,b* are rotatably coupled to the tool housing 141 each about a respective axis, such as using pins 164, thus allowing drive gears 146*a,b* each to rotate on an axis parallel to the axis of tool housing 141 during rotation of drill string 108. Accordingly, when drill string 108 (along with tool housing 141) is rotated while sleeve 156 grips the wall of wellbore 112, power is transferred from the drill string 108 to the drive mechanism 144 to power pumping mechanism 152. Specifically, as further described below with respect to FIGS. 1-2D, rotation of the drill string 108 rotates the tool housing 141 as the same angular rate as the drill string 108. The rotation of the tool housing 141 causes the drive gears 146*a*, 146*b* to roll along the gear ring 162, with a corresponding rotation of the drive gears 146*a*, 146*b* about their own axes as rotatably coupled to the tool housing 141. The rotation of the drive gears 146*a*, 146*b* about their axes powers rotation to the central gear 150, which drives the pump.

Note that in this embodiment, the positioning of the two drive gears 146*a*, 146*b* opposite one another with respect to drive shaft 148 helps balance lateral forces to minimize or avoid any lateral forces on the drive shaft 148, i.e. transverse to the axis of rotation of the drive shaft 148. It should be understood, however, that other embodiments may use a different number of drive gears circumferentially spaced about the drive shaft 148 and meshed with the central gear 150. Even an embodiment with a single drive gear positioned between the gear ring 162 and the central drive gear 150 is feasible, even though the above-described lateral force balancing of multiple drive gears may not be provided by such a single drive-gear embodiment.

As previously described, drive gears 146*a,b* may take the form of toothed members, with each gear positioned along tool housing 141 and rotatably secured for rotation about a respective gear axis of that gear. As shown in FIG. 2A, drive gears 146*a,b* each include a portion which extends out from tool housing 141 and a portion which extends into tool housing 141. Central gear 150 of drive shaft 148 is positioned between drive gears 146*a* and 146*b*, and it includes teeth which mesh with the teeth of drive gears 146*a,b* such that, during rotation of drill string 108, the generated rotational force is transmitted from drive gears 146*a,b* to drive shaft 148.

As also previously described, the outer surface of rotational sleeve 156 comprises a gripping member 158 that engages the wall of wellbore 112. The profile of gripping member 158 is designed such that it allows vertical movement of bottom hole 120 along wellbore 112 (using the weight of the drill string, for example), while also preventing rotational movement of sleeve 156. Although not shown, in certain embodiments, gripping member 158 may be an engaging plate mounted on bow springs which exert force outwardly such that contact is maintained between the plate and the wall of the casing or wellbore. The bow spring can be selected to apply the force necessary in any given application, as would be understood by those ordinarily skilled persons described herein. Alternatively, a casing scraper or other similar device may be used in place of the spring to ensure the gripping member remains secure against the wall.

In addition, gripping members 158 may be configured such that, although rotating sleeve is in intimate contact with the wall of wellbore 112, the annular flow path of annulus 140 is still maintained so that circulation operations may be conducted. To achieve this, gripping member 158 may take a variety of forms including, but not limited to, angled blades as shown in FIG. 1 or a plurality of offset elements as shown in FIG. 2C which form a fluid flow channel around gripping members 158. FIG. 2C is a three-dimensional view of downhole tool 124 which includes a plurality of exemplary offset gripping members 158.

Figure 2D:
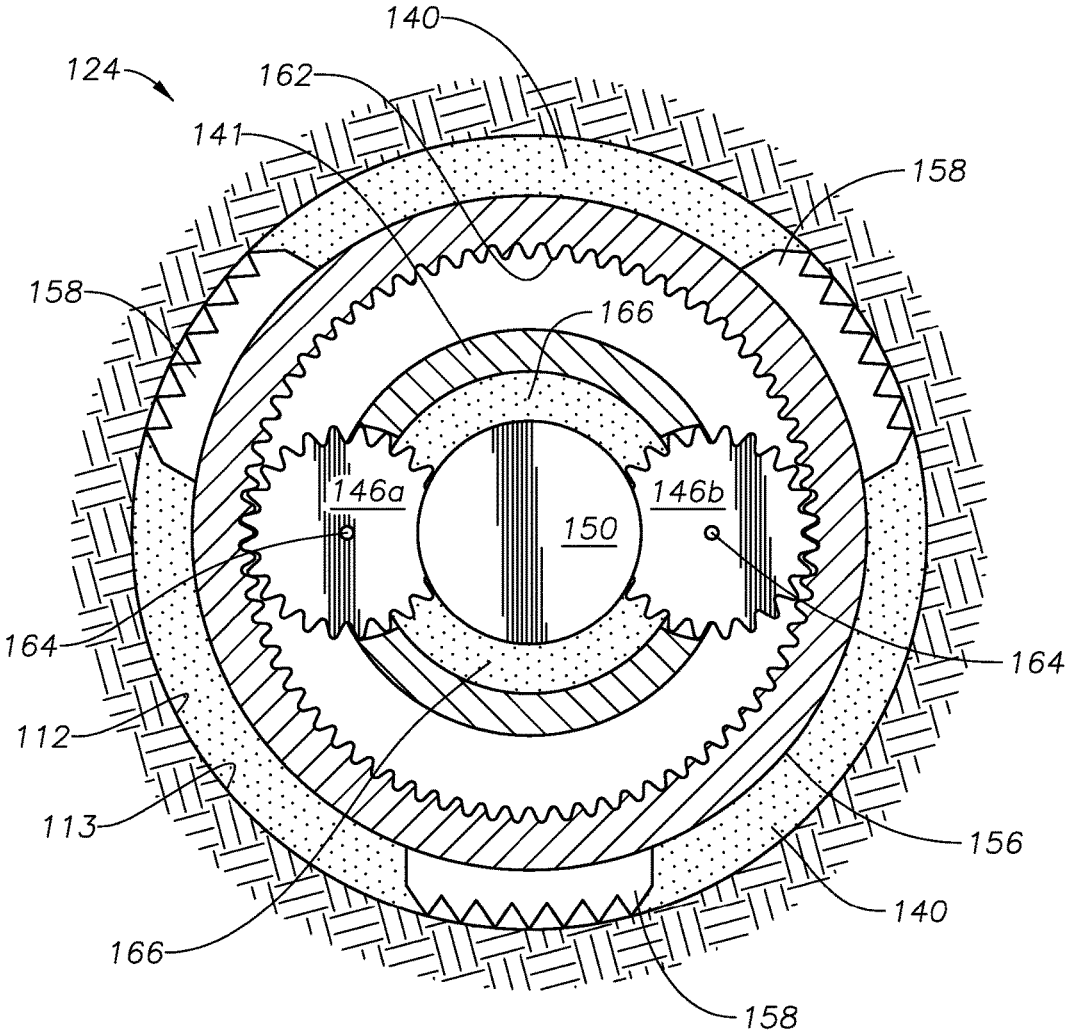
FIG. 2D is a sectional topside view of a downhole tool taken along line 2D of FIG. 2A.

To illustrate the flow of fluid during circulation, FIG. 2D is provided which illustrates a sectional topside view of downhole tool 124 taken along line 2D of FIG. 2A. Here, gripping members 158 are engaged to the wall 113 of wellbore 112 such that sleeve 156 is rotationally immobilized (i.e., it cannot rotate). Wall 113 may be a casing, liner or formation surface, as the present disclosure is useful in cased and open-hole applications. During an exemplary circulation operation, fluid is pumped down through internal flow area 166 (bore 142), past drive mechanism 144, and into pumping mechanism 152 whereby the pressure of the fluid is increased, which provides increased annular velocities. Thereafter, the fluid is forced out the bottom of bottom hole assembly 120, around sleeve 156 as shown, and back up annulus 140.

Now that the various components of an exemplary downhole tool 124 have been described, an exemplary methodology utilizing downhole tool 124 will now be described with reference to FIGS. 1-2D. During a drilling operation, for example, drill string 108 is lowered into wellbore 112 until a desired location is reached. As drill bit 126 drills the formation, gripping member 158 allows sleeve 156 to vertically slide along the wall of wellbore 112. However, when drill string 108 is rotated, gripping members 158 engage the wall, thus immobilizing sleeve 156. Thereafter, as fluid L (FIG. 2A) flows through drill string 108 (being pumped by mud pump 132) and through internal flow area 166, drill string 108 is rotated such that tool housing 141 is also rotated, thus creating a rotational force. As tool housing 141 rotates, drive gears 146*a,b* begin to rotate along pins 164 as its teeth mate with rotationally immobilized gear ring 162 of sleeve 156.

As drive gears 146*a,b* continue to rotate, they transfer the rotational force to central gear 150 of drive shaft 148, thus causing it to rotate. As drive shaft 148 rotates, it then transfers the rotational force to pump mechanism 152, thereby rotating impeller plates 154 which increases the pressure of fluid L as it flows through each plate 154, as will be understood by those ordinarily skilled in the art having the benefit of this disclosure. Fluid L then flows through bearing support 155 coupled to the lower end of pump mechanism 152. Bearing support 155 comprises three or four radial arms (not shown) which extend outwardly (akin to wheel spokes), such that a plurality of flow channels 157 are formed which allow Fluid L to flow therethrough. Fluid L is then forced down through drill collar 122, out of drill bit 126, up annulus 140 (around sleeve 156), and back to surface 104 for further circulation processing. Accordingly, rotation of drill string 108 is used to produce a rotational force that is harnessed by downhole tool 124 in order to increase the pressure of the circulating fluid, thus permitting higher annular velocities. Moreover, since sleeve 156 allows vertical movement of bottom hole assembly 120, bottom hole assembly 120 can be moved up or down wellbore 112 as desired while also boosting of the fluid pressure.

Figure 3A:
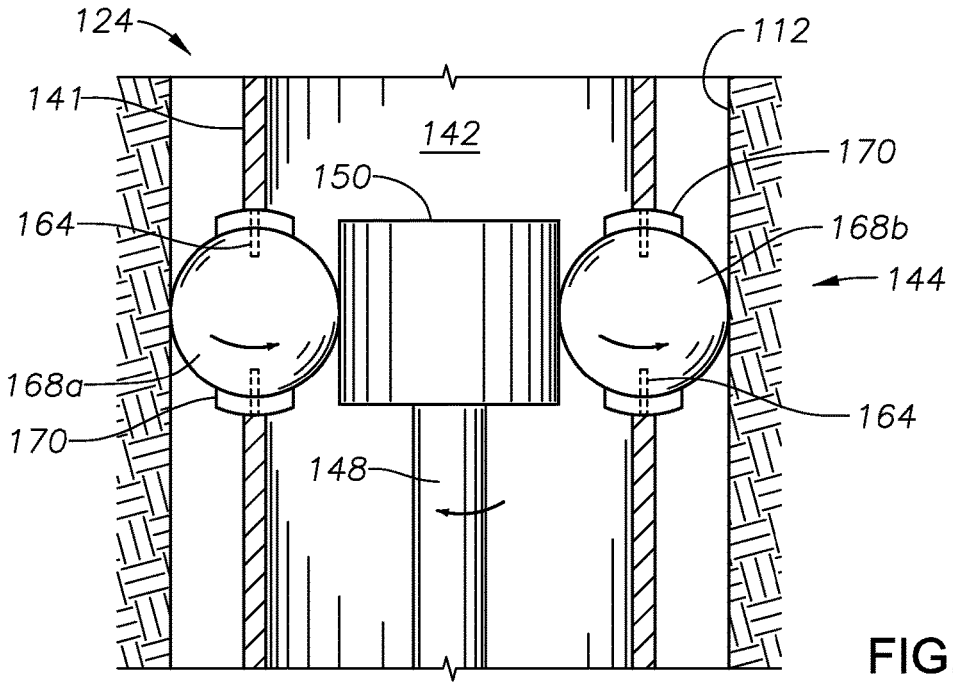
FIG. 3A illustrates an alternative embodiment of a drive mechanism used in a downhole tool, according to certain exemplary embodiments of the present disclosure.
Figure 3B:
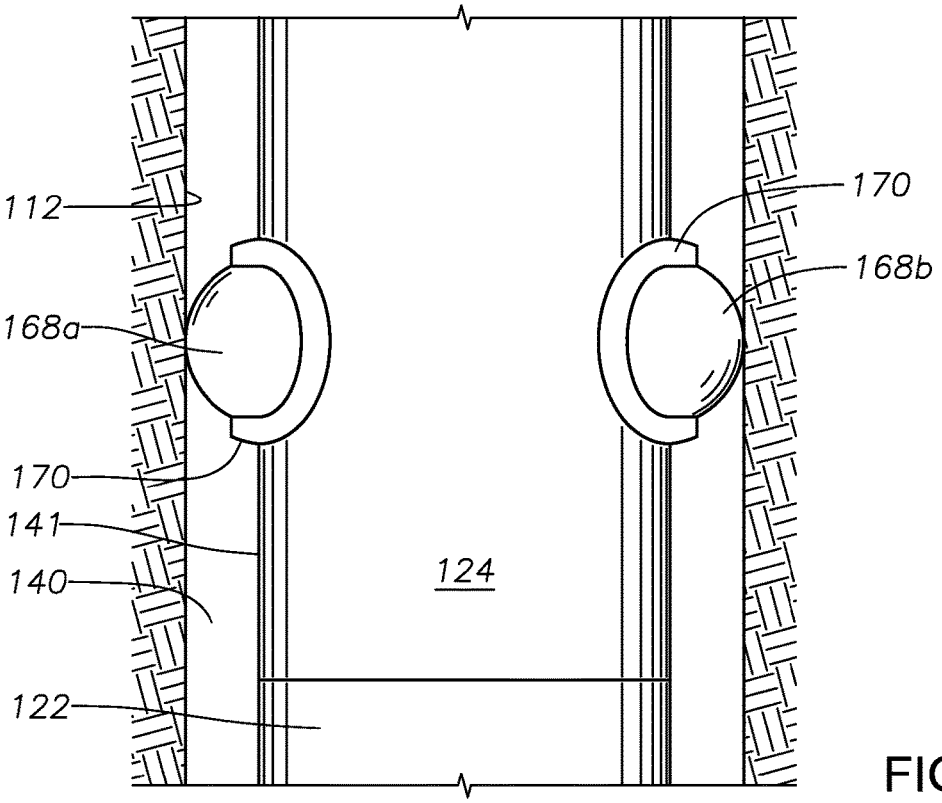
FIG. 3B illustrates a three-dimensional external view of the downhole tool of FIG. 3A.

FIG. 3A illustrates an alternative embodiment of drive mechanism 144, according to certain exemplary embodiments of the present disclosure. In this embodiment, no sleeve is used; instead, a first and second friction transfer element 168*a,b* is used in place of drive gears 146*a,b*, respectively. A mechanical seal 170 is positioned around first and second friction elements 168*a,b* in order to prevent fluid leakage. As previously described, first and second friction transfer elements are secured to tool housing 141 using pins 164. Thus, a portion of first and second friction transfer elements 168*a,b* extends out from tool housing 141, while another portion extends into tool housing 141. The diameter spanning from transfer element 168*a* to 168*b* is selected such that a sufficient amount of friction is provided between friction transfer elements 168*a,b* and the wellbore wall to create the rotational force. Since friction transfer elements 168*a,b* are spaced around tool housing 141, fluid is allowed to flow past them during circulation, as shown in FIG. 3B which illustrates a three-dimensional external view of downhole tool 124.

The portions of the first and second friction transfer elements 168*a,b* which extends out of tool housing 141 engage the wall of wellbore 112. In this example, central gear 150 may comprise teeth along its outer diameter or may also be a friction-type surface sufficient to transfer rotational force. When drill string 108 is rotated, first and second friction transfer elements 168*a,b* begin to rotate along pins 164, thus creating a rotational force that is transferred to central gear 150 as previously described. In turn, pump mechanism 152 is powered as described above. Friction transfer elements 168*a,b* may be, for example, polymer or metal friction balls or some other suitable friction transfer element. In addition, the flow of fluid through downhole tool 124 of FIGS. 3A-3B, around first and second friction transfer elements 168*a,b*, and back up annulus 140 are the same as described in previous embodiments. Accordingly, rotation of drill string 108 is used to produce a rotational force that is harnessed by downhole tool 124 in order to increase the pressure of the fluid.

Accordingly, through use of the present disclosure, the power of drill string rotation is harnessed in order to drive a pump mechanism which increases the pressure of the circulating fluid, thus permitting higher annular velocities. Thus, higher pump rates are provided beyond that supplied by traditional mud pumps. Additionally, through use of the present disclosure, the standpipe pressure may be reduced, thus increasing the overall pressure drop in the circulating system, thereby allowing the mud pumps to operating at a faster rate. Such increased fluid pressure may be used to increase the maximum pump rate and annular velocity, for example, to enhance hole cleaning while drilling and casing cleaning during displacement operations.

Exemplary embodiments of the downhole tools described herein are particularly useful in, for example, displacement operations whereby the tool is secured against a casing or liner. Alternatively, the downhole tool may be used in drilling operations, whereby the tool is secured up against a rock formation. In the latter embodiment, the downhole tool may be positioned in close proximity to the bottom of the drill string to maximize the increase in annular velocity, such as, for example, roughly 95 feet away from the bit.

An exemplary embodiment of the present disclosure provides a tool for boosting fluid pressure downhole, the tool comprising a tool housing configured for coupling to a drill string, the tool housing defining a fluid flow passage; a sleeve rotatably positioned around the tool housing, the sleeve comprising one or more gripping members on an outer portion of the sleeve configured to grip a wellbore wall; a drive shaft passing through the tool housing and having a central gear; at least one drive gear rotatably coupled to the sleeve, the at least one drive gear meshing both with an inner portion of the sleeve and with the central gear; and a pump mechanism coupled to the drive shaft to receive power imparted by rotation of the drive shaft, the pump configured to increase a fluid pressure within the flow passage. In another embodiment, the pump comprises a multi-stage impeller assembly. In yet another, the at least one drive gear is rotatably coupled about an axis parallel to an axis of the tool housing.

In another embodiment of the present disclosure, the tool further comprises a plurality of teeth along the inner portion of the rotating sleeve; a plurality of teeth on the at least one drive gear; and a plurality of teeth on the central gear of the drive shaft, wherein the teeth on the at least one drive gear mesh both with the teeth along the inner portion of the rotating sleeve and the teeth on the central gear. In yet another, the at least one drive gear comprises a plurality of drive gears circumferentially spaced about the drive shaft. In another, the tool further comprises a plurality of offset elements defining a fluid flow channel about the one or more gripping member.

Another exemplary embodiment of the present disclosure provides a tool for boosting fluid pressure downhole, the tool comprising a tool housing which rotates in relation to a wellbore wall, the tool housing defining a flow passage in which fluid can flow; a drive gear comprising: a first friction transfer element having a portion which extends out from the tool housing and a portion which extends into the tool housing; and a second friction transfer element having a portion which extends out from the tool housing and a portion which extends into the tool housing, wherein the portions of the first and second friction transfer elements that extend out from the tool housing grip the wellbore wall to create a rotational force when the tool housing is rotated; a drive shaft operationally coupled to the first and second friction transfer elements whereby, during rotation of the tool housing, the first and second friction transfer elements transfer the rotational force to the drive shaft, thereby resulting in rotation of the drive shaft; and a pump mechanism positioned along the flow passage and operationally coupled to the drive shaft to thereby receive the rotational force imparted by the drive shaft, thus driving the pump mechanism to boost a pressure of fluid traveling through the flow passage.

In an alternate embodiment, the first and second friction transfer elements are friction balls. In yet another, the first and second friction transfer elements rotate on an axis parallel to an axis of the tool housing during rotation of the tool housing. In any of the foregoing embodiments, the wellbore may be cased. Moreover, in those same exemplary embodiments, the tool forms part of a drilling or completion assembly.

An exemplary methodology of the present disclosure provides a method for boosting fluid pressure in a wellbore, the method comprising positioning a downhole tool at a desired location along the wellbore, whereby fluid travels through a flow passage of the downhole tool; rotating the downhole tool in relation to an opposing surface to produce a rotational force; and utilizing the rotational force to drive a pump mechanism to thereby boost a pressure of the fluid traveling through the downhole tool. Another method further comprises increasing an annular velocity of the fluid in response to the pressure boost. In yet another method, rotating the downhole tool to produce the rotational force further comprises gripping the opposing surface using a rotating sleeve positioned around the downhole tool; rotating the downhole tool while the rotating sleeve remains stationary; rotating a drive gear operationally coupled to the rotating sleeve in response to rotation of the downhole tool; and rotating a drive shaft operationally coupled to the drive gear in response to rotation of the drive gear. In another, driving the pumping mechanism further comprises driving the pumping mechanism in response to the rotation of the drive shaft.

In yet another method, rotating the downhole tool to produce the rotational force further comprises gripping the opposing surface using a friction transfer element positioned along the downhole tool; rotating the downhole tool; rotating the friction transfer element in response to rotation of the downhole tool; and rotating a drive shaft operationally coupled to the friction transfer element in response to rotation of the friction transfer element. Another method further comprises forcing the fluid out of the downhole tool and up through an annulus formed between the downhole tool and the opposing surface. In another, gripping the opposing surface further comprises gripping a surface of a casing, liner or formation. In yet another, positioning the downhole tool at the desired location along the wellbore further comprises deploying the downhole tool as part of a drilling or completion assembly.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A tool for boosting fluid pressure downhole, the tool comprising:

a tool housing configured for coupling to a drill string, the tool housing defining a fluid flow passage;

a sleeve rotatably positioned around the tool housing, the sleeve comprising one or more gripping members on an outer portion of the sleeve configured to grip a wellbore wall;

a drive shaft passing through the tool housing and having a central gear;

at least one drive gear rotatably coupled to the sleeve, the at least one drive gear meshing both with an inner portion of the sleeve and with the central gear, wherein the at least one drive near is rotatably coupled about an axis parallel to an axis of the tool housing; and a pump mechanism coupled to the drive shaft to receive power imparted by rotation of the drive shaft, the pump configured to increase a fluid pressure within the flow passage.

2. The tool as defined in claim 1, wherein the pump comprises a multi-stage impeller assembly.

3. The tool as defined in claim 1, further comprising:

a plurality of teeth along the inner portion of the rotating sleeve;

a plurality of teeth on the at least one drive gear; and a plurality of teeth on the central gear of the drive shaft, wherein the teeth on the at least one drive gear mesh both with the teeth along the inner portion of the rotating sleeve and the teeth on the central gear.

4. The tool as defined in claim 3, wherein the at least one drive gear comprises a plurality of drive gears circumferentially spaced about the drive shaft.

5. The tool as defined in claim 1, further comprising a plurality of offset gripping members defining a flow channel between the outer surface of the sleeve and the wellbore wall.

6. A tool for boosting fluid pressure downhole, the tool comprising:

a tool housing which rotates in relation to a wellbore wall, the tool housing defining a flow passage in which fluid can flow;

a drive gear comprising:

a first friction transfer element having a portion which extends out from the tool housing and a portion which extends into the tool housing; and a second friction transfer element having a portion which extends out from the tool housing and a portion which extends into the tool housing, wherein the portions of the first and second friction transfer elements that extend out from the tool housing grip the wellbore wall to create a rotational force when the tool housing is rotated, wherein the drive gear is rotatably coupled about an axis parallel to an axis of the tool housing;

a drive shaft operationally coupled to the first and second friction transfer elements whereby, during rotation of the tool housing, the first and second friction transfer elements transfer the rotational force to the drive shaft, thereby resulting in rotation of the drive shaft; and a pump mechanism positioned along the flow passage and operationally coupled to the drive shaft to thereby receive the rotational force imparted by the drive shaft, thus driving the pump mechanism to boost a pressure of fluid traveling through the flow passage.

7. The tool as defined in claim 6, wherein the first and second friction transfer elements are friction balls.

8. The tool as defined in claim 6, wherein the first and second friction transfer elements rotate on an axis parallel to an axis of the tool housing during rotation of the tool housing.

9. The tool as defined in claim 1 or 6, wherein the wellbore wall is cased.

10. The tool as defined in claim 1 or 6, wherein the tool forms part of a drilling or completion assembly.

11. A method for boosting fluid pressure in a wellbore, the method comprising:

positioning a downhole tool at a desired location along the wellbore, whereby fluid travels through a flow passage of the downhole tool;

rotating the downhole tool in relation to an opposing surface to produce a rotational force, wherein rotating the downhole tool to produce the rotational force further comprises:

gripping the opposing surface using a rotating sleeve positioned around the downhole tool;

rotating the downhole tool while the rotating sleeve remains stationary;

rotating a drive gear operationally coupled to the rotating sleeve in response to rotation of the downhole tool, wherein the drive gear is rotatably coupled about an axis parallel to an axis of the tool housing;

rotating a drive shaft operationally coupled to the drive gear in response to rotation of the drive gear; and utilizing the rotational force to drive a pump mechanism to thereby boost a pressure of the fluid traveling through the downhole tool.

12. The method as defined in claim 11, further comprising increasing an annular velocity of the fluid in response to the pressure boost.

13. The method as defined in claim 11, wherein rotating the downhole tool to produce the rotational force further comprises:

gripping the opposing surface using a friction transfer element positioned along the downhole tool;

rotating the downhole tool;

rotating the friction transfer element in response to rotation of the downhole tool; and rotating a drive shaft operationally coupled to the friction transfer element in response to rotation of the friction transfer element.

14. The method as defined in claim 11, wherein driving the pumping mechanism further comprises driving the pumping mechanism in response to the rotation of the drive shaft.

15. The method as defined in claim 12 or 13, wherein gripping the opposing surface further comprises gripping a surface of a casing, liner or formation.

16. The method as defined in claim 11, further comprising forcing the fluid out of the downhole tool and up through an annulus formed between the downhole tool and the opposing surface.

17. The method as defined in claim 11, wherein positioning the downhole tool at the desired location along the wellbore further comprises deploying the downhole tool as part of a drilling or completion assembly.

* * * * *